US008089260B2

(12) United States Patent
Yang

(10) Patent No.: US 8,089,260 B2
(45) Date of Patent: Jan. 3, 2012

(54) LOW VOLTAGE BANDGAP REFERENCE CIRCUIT

(75) Inventor: Chih-Hsun Yang, Xihu Town, Changhua County (TW)

(73) Assignee: Novatek Microelectronics Corp., Hsinchu (TW)

( * ) Notice: Subject to any disclaimer, the term of this patent is extended or adjusted under 35 U.S.C. 154(b) by 368 days.

(21) Appl. No.: 12/493,645

(22) Filed: Jun. 29, 2009

(65) Prior Publication Data

US 2010/0164465 A1 Jul. 1, 2010

(30) Foreign Application Priority Data

Dec. 26, 2008 (TW) ..... 97151102 A

(51) Int. Cl.
*G05F 3/16* (2006.01)
*G05F 1/10* (2006.01)

(52) U.S. Cl. ..... 323/313; 327/539

(58) Field of Classification Search ..... 323/313, 323/314; 327/538, 539
See application file for complete search history.

(56) References Cited

U.S. PATENT DOCUMENTS

| | | | | |
|---|---|---|---|---|
| 6,853,238 | B1 * | 2/2005 | Dempsey et al. | 327/539 |
| 7,170,274 | B2 * | 1/2007 | Mukherjee et al. | 323/313 |
| 7,268,529 | B2 | 9/2007 | Mochizuki et al. | |
| 7,612,606 | B2 * | 11/2009 | Marinca | 327/539 |
| 7,750,728 | B2 * | 7/2010 | Marinca | 327/539 |

FOREIGN PATENT DOCUMENTS

CN 1928766 A 3/2007

* cited by examiner

*Primary Examiner* — Matthew Nguyen
(74) *Attorney, Agent, or Firm* — Rabin & Berdo, P.C.

(57) ABSTRACT

A bandgap reference circuit provided for generating an output reference substantially independent of temperature and power includes a first reference signal generator, a first impedance, a second reference signal generator and a second impedance. The first reference signal generator can generate a first reference signal proportional to absolute temperature. The second reference signal generator generates a second reference signal complementary to absolute temperature according to the first reference signal. The second impedance, the serially-coupled first impedance and second reference signal generator, and the first reference signal generator are coupled in parallel between two nodes. The bandgap reference circuit outputs the output reference voltage through the two nodes. According to an embodiment of the invention, the bandgap reference circuit can be implemented by an additional circuit of lower complexity to obtain a lower reference voltage.

20 Claims, 7 Drawing Sheets

LOW VOLTAGE BANDGAP REFERENCE CIRCUIT

This application claims the benefit of Taiwan application Serial No. 97151102, filed Dec. 26, 2008, the subject matter of which is incorporated herein by reference.

BACKGROUND OF THE INVENTION

1. Field of the Invention

The invention relates in general to a bandgap reference circuit, and more particularly to a low voltage bandgap reference circuit.

2. Description of the Related Art

The bandgap reference circuit is widely applied in an integrated circuit, typically for supplying a reference voltage of about 1.25V. The reference voltage is more accurate than a voltage supplied by an external power source and less influenced by temperature and power supply variation. The bandgap reference circuit uses a circuit operating proportional to the absolute temperature to compensate a negative temperature coefficient between a base and an emitter of a bipolar transistor in order to obtain a reference voltage substantially independent of temperature variation.

In order to meet the application requirement of different integrated circuits, a reference voltage smaller than the standard voltage 1.25V is needed. For example, referring to FIG. 1, a circuit diagram of a bandgap reference circuit of a conventional analog system is shown. The circuit derives from a book "DESIGN OF ANALOG CMOS INTEGRATED CIRCUITS" written by Behzad Razavi. In FIG. 1, nodes E and F of a core circuit 110 of a bandgap reference circuit 100 are respectively coupled to two input terminals of an operational amplifier 125 of an additional circuit 120 and resistors are coupled between the two input terminals and two output terminals of the operational amplifier 125. By this design, the bandgap reference circuit 100 can generate a reference voltage, which can be adjusted.

As such, in order to obtain a reference voltage lower than 1.25V, conventionally, an additional circuit, such as the additional circuit 120 of FIG. 1, is employed to be connected to the core circuit of the bandgap reference circuit. The additional circuit is normally composed of complicated analog elements, thereby increasing the circuit area of the whole system and thus the circuit complexity and production cost.

SUMMARY OF THE INVENTION

The invention is directed to a low voltage bandgap reference circuit capable of generating a low reference voltage. According to an embodiment of the invention, the low voltage bandgap reference circuit can generate the reference voltage by using an additional circuit of lower complexity.

According to a first aspect of the present invention, a bandgap reference circuit is provided for generating an output reference voltage. The bandgap reference circuit comprises a first reference signal generator, a first impedance, a second reference signal generator, and a second impedance. The first reference signal generator has an output terminal coupled to a first node and generates a first reference signal proportional to absolute temperature from the output terminal. The second reference signal generator is coupled to the first impedance in series and generates a second reference signal complementary to absolute temperature according to the first reference signal. The second impedance, the serially-coupled first impedance and second reference signal generator, and the first reference signal generator are coupled in parallel between the first node and a second node. The bandgap reference circuit outputs the output reference voltage through the first node and the second node.

According to a second aspect of the present invention, a bandgap reference circuit is provided for generating an output reference voltage. The bandgap reference circuit comprises a first reference signal generator, a first impedance, a second reference signal generator, and a second impedance. The first reference signal generator has an output terminal coupled to a first node and generates a first reference signal complementary to absolute temperature from the output terminal. The second reference signal generator is coupled to the first impedance in series and generates a second reference signal proportional to absolute temperature according to the first reference signal. The second impedance, the serially-coupled first impedance and second reference signal generator, and the first reference signal generator are coupled in parallel between the first node and a second node. The bandgap reference circuit outputs the output reference voltage through the first node and the second node.

In the above-mentioned bandgap reference circuits, the first reference signal compensates with the second reference signal such that the output reference voltage is substantially independent of temperature and power supply, and the output reference voltage is substantially determined by the first impedance, the second impedance, and a bandgap voltage value.

The invention will become apparent from the following detailed description of the preferred but non-limiting embodiments. The following description is made with reference to the accompanying drawings.

DETAILED DESCRIPTION OF THE INVENTION

Embodiment One

Figure 1:
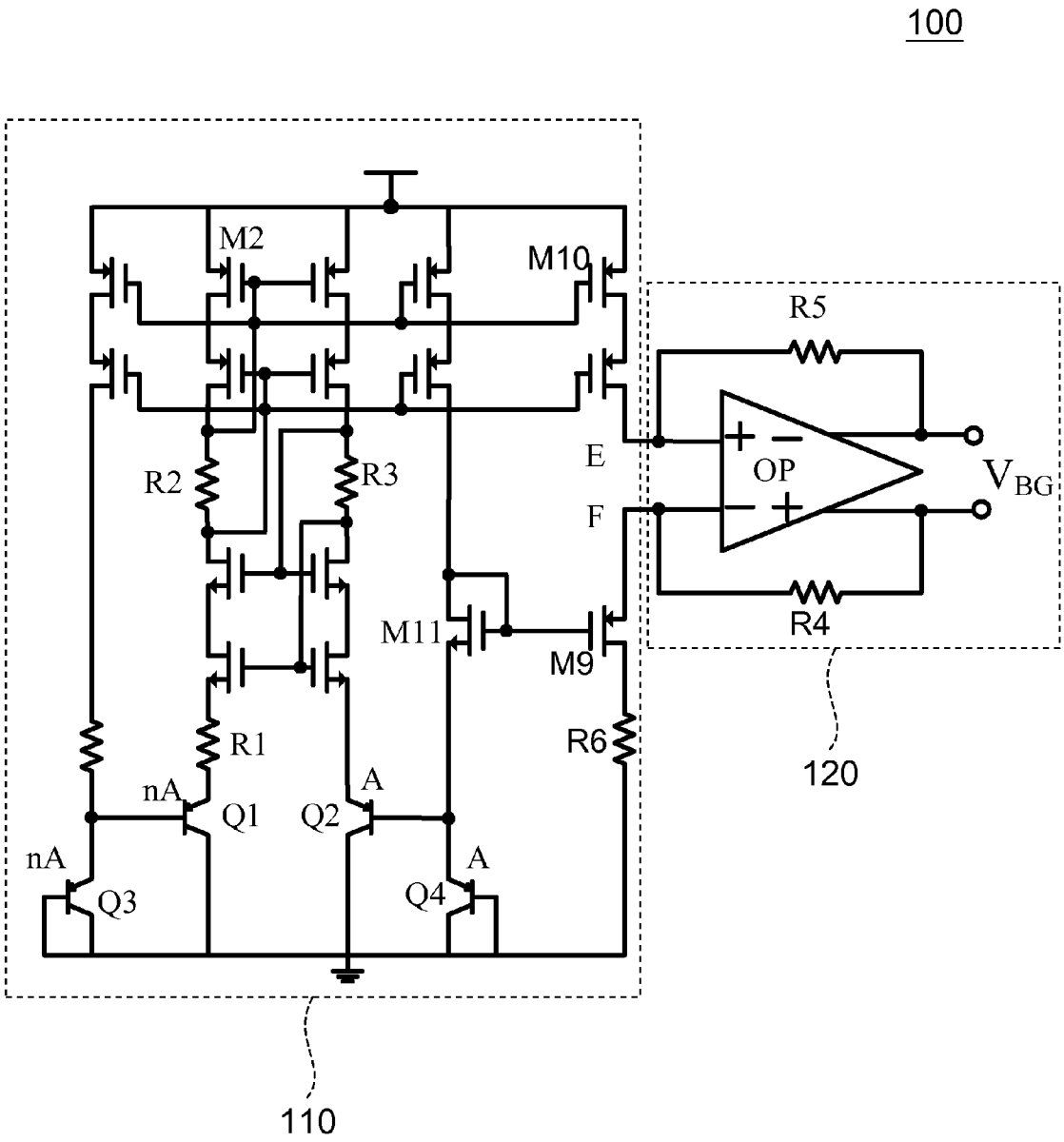
FIG. 1(PRIOR ART)
FIG. 1 is a circuit diagram of a conventional bandgap reference circuit.
Figure 2:
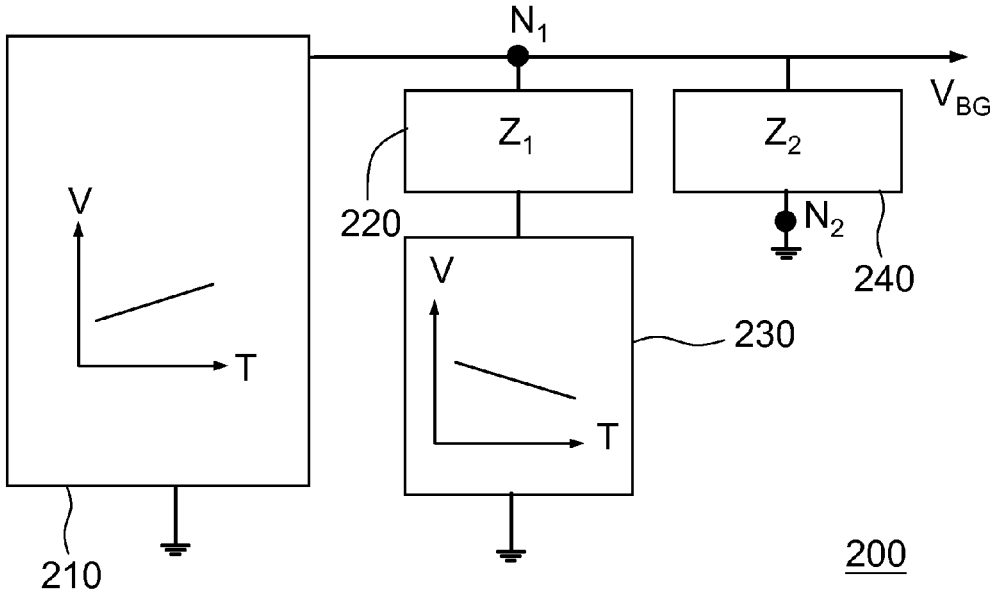
FIG. 2 is a block diagram of a bandgap reference circuit according to a first embodiment of the invention.

Referring to FIG. 2, a block diagram of a bandgap reference circuit is shown according to a first embodiment of the invention. In FIG. 2, a bandgap reference circuit 200 is used for generating an output reference voltage $V_{BG}$. The bandgap reference circuit 200 includes a first reference signal generator 210, a first impedance 220, a second reference signal generator 230 and a second impedance 240. The bandgap reference voltage $V_{BG}$ is substantially independent of temperature and is determined by impedances $Z_1$ and $Z_2$ of the first impedance 220 and the second impedance 240. As shown below, the output reference voltage $V_{BG}$ can be used to obtain a bandgap reference voltage smaller than the standard value 1.25V.

The first reference signal generator 210 has an output terminal coupled to a first node N1 and generates a first reference signal proportional to absolute temperature (PTAT) from the output terminal, such as a current $I_{PTAT}$ having a positive temperature coefficient. The first impedance ($Z_1$) 220 is coupled in series with the second reference signal generator 230. The second reference signal generator 230 generates a second reference signal complementary to absolute temperature (CTAT), such as a voltage having a negative temperature coefficient, according to the first reference signal. The second impedance 240, the serially-coupled first impedance and second reference signal generator 230, and the first reference signal generator 210 are coupled in parallel between the first node N1 and a second node N2. The three mentioned above, as shown in FIG. 2 for example, are coupled in parallel between the first node N1 and a ground terminal (or a certain voltage terminal), and thus can be regarded as being coupled in parallel between two nodes. The bandgap reference circuit 200 outputs the output reference voltage $V_{BG}$ through the first node $N_1$ and the second node $N_2$.

The first reference signal compensates for the second reference signal such that the reference voltage $V_{BG}$ is substantially independent of temperature and power supply and the output reference voltage $V_{BG}$ is substantially determined by the first impedance 220, the second impedance 240 and a bandgap voltage value, such as a value of about 1.25V.

The second impedance 240 is for making the output reference voltage $V_{BG}$ smaller than the bandgap voltage.

Figure 3:
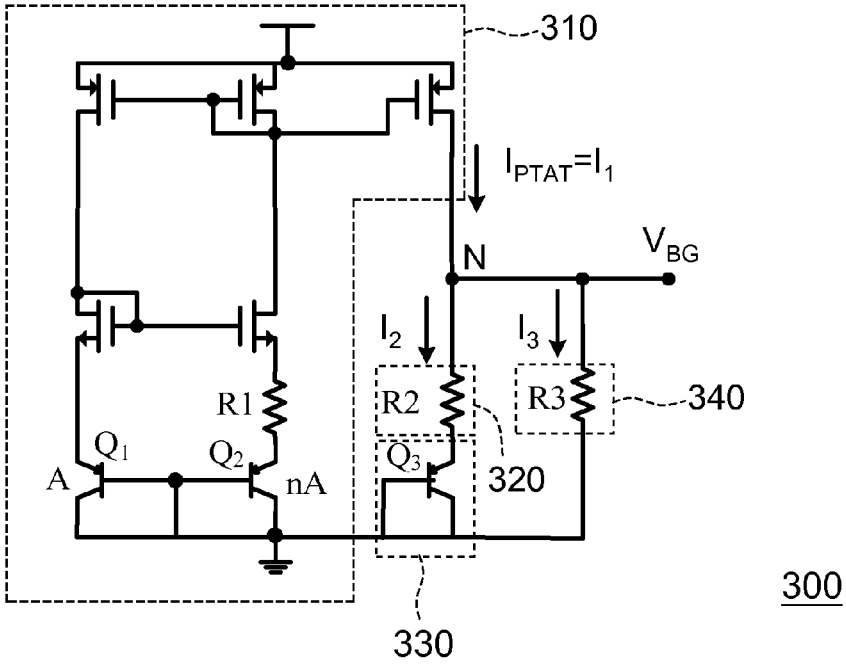
FIG. 3 is a circuit diagram of an example of the bandgap reference circuit according to the first embodiment of the invention.

Referring to FIG. 3, the bandgap reference circuit is an example according to the first embodiment of the invention, wherein the first impedance and second impedance are both resistors. In FIG. 3, the bandgap reference circuit 300 includes a first reference signal generator 310, a first resistor 320, a second reference signal generator 330, and a second resistor 340. The bandgap reference circuit 300 outputs the output reference voltage $V_{BG}$ through a node N and a ground terminal.

In FIG. 3, the first reference signal generator 310 outputs a current $I_{PTAT}$ having a positive temperature coefficient at the node N. The current $I_{PTAT}$ is denoted as $I_1$. After current distribution at the node N, the voltage drop across the first resistor 320 is a voltage $I_2R_2$ proportional to absolute temperature. The second reference signal generator 330 includes a transistor $Q_3$ operating according to a constant current and generates a voltage complementary to absolute temperature, i.e., a voltage $V_{BE3}$ having a negative temperature coefficient. The voltage $I_2R_2$ proportional to absolute temperature compensates with the voltage $V_{BE3}$ complementary to absolute temperature such that the output reference voltage $V_{BG}$ is substantially independent of the temperature and power supply.

In the following calculation, the output voltage reference $V_{BG}$ is calculated according to a loop formed by the node N and first resistor 320, the second reference signal generator 330 and the second resistor 340. From the above analytic circuit, the following equations can be obtained:

$$I_1=I_2+I_3 \tag{1}$$

$$V_{BG}=I_3R_3=V_{BE3}+I_2R_2 \tag{2}$$

Substitution of $I_3$ of the equation (2) by the equation (1) is performed and $I_2$ is represented in terms of $V_{BE3}$ and $I_1$, thus obtaining the following equation:

$$I_2=\frac{I_1R_3-V_{BE3}}{R_2+R_3} \tag{3}$$

The equation (2) can be expressed as below by substituting $I_2$ of the equation (3) into the equation (2):

$$V_{BG}=V_{BE3}+\left(\frac{I_1R_3-V_{BE3}}{R_2+R_3}\right) \tag{4}$$

$$\begin{aligned} R_2 &= \frac{V_{BE3}R_3+I_1R_3R_2}{R_2+R_3} \\ &= \frac{R_3}{R_2+R_2}(V_{BE3}+I_1R_2) \\ &= \frac{R_3}{R_2+R_3}\left(V_{BE3}+\frac{V_T\ln n}{R_1}R_2\right) \\ &\approx \frac{R_3}{R_2+R_3}\times 1.25 \end{aligned}$$

As above, the value 1.25V indicates the conventional bandgap reference voltage, and is called a bandgap reference voltage value, denoted by $V_g$.

The bandgap reference voltage value $V_g$ can be obtained by the following calculations. The voltage difference $\Delta V_{BE}$ between the transistors Q1 and Q2 of the first reference signal generator 310 is divided by $R_1$ to obtain a current $I_{PTAT}$, i.e., $I_1$, having a positive temperature coefficient. The following relationship can be obtained:

$$I_{PTAT}=\Delta V_{BE}/R_1=(V_T\ln n)/R_1$$

Under the room temperature, $\partial V_{BE}/\partial T\approx-1.5$ mV/K and $\partial V_T/\partial T\approx+0.087$ mV/K. In order to make $V_{BG}$ to be a voltage source with a zero temperature coefficient, it can be obtained:

$$(0.087\text{ mV/K})\ln n\cdot(R_2/R_1)=1.5\text{ mV/K}$$

$$\ln n\cdot(R_2/R_1)=1.5/0.087\approx 17.2$$

Therefore, the expression $V_{BE\ 3}+(V_T\ln n)(R_2/R_1)\approx 1.25$V in the equation (4) indicates the conventional bandgap voltage of about 1.25V.

The output reference voltage $V_{BG}$ of the bandgap reference circuit 300 as shown in FIG. 3 is substantially obtained by $Vg\times Z_2/(Z_1+Z_2)$, wherein $Z_1$, $Z_2$ and $V_g$ represent the first impedance, the second impedance, and the bandgap voltage value, respectively. In FIG. 3, $Z_1=R_2$, $Z_2=R_3$, $V_g=1.25$V. From the equation (4), it can be obtained that the output reference voltage $V_{BG}$ is smaller than 1.25V, and can be adjusted according to the value of $R_2$ or $R_3$.

Figure 4A:
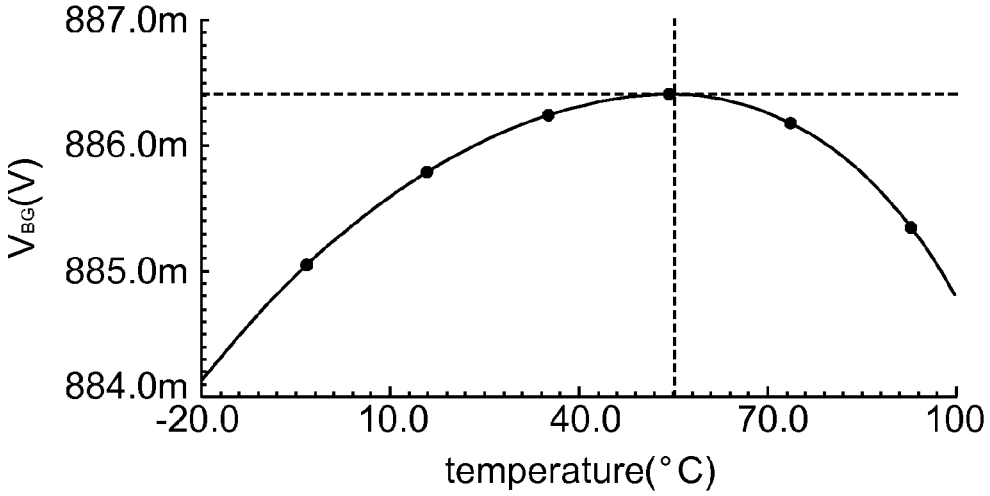
FIG. 4A is a simulation graph of the output reference voltage $V_{BG}$ of the bandgap reference circuit to temperature under different supply voltages when $R_2$=199 KΩ and $R_3$=597Ω.
Figure 4B:
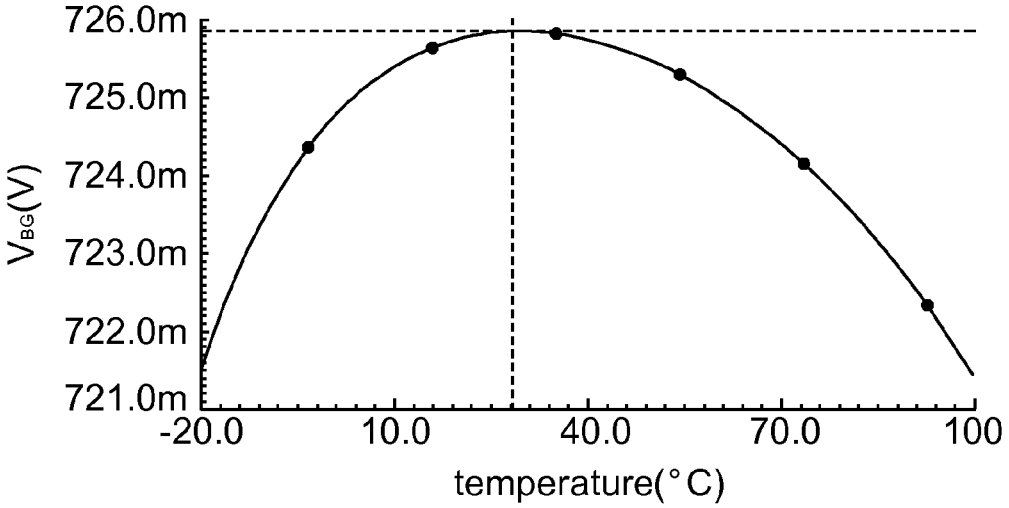
FIG. 4B is a simulation graph of the output reference voltage $V_{BG}$ of the bandgap reference circuit to temperature under different supply voltages when $R_2$=378 KΩ and $R_3$=696 KΩ.

FIG. 4A shows a simulation graph of the output reference voltage $V_{BG}$ of the bandgap reference circuit to temperature under different source voltages when $R_2$=199 KΩ and $R_3$=597Ω. FIG. 4B shows a simulation graph of the output reference voltage $V_{BG}$ of the bandgap reference circuit to temperature under different source voltages when $R_2$=378 KΩ and $R_3$=696 KΩ. In the simulation represented by FIG. 4A (or FIG. 4B), the supply voltages are set to be 3V, 3.3V and 3.6V, respectively. The three curves representing the relationship of the output reference voltage $V_{BG}$ with respect to temperature under the three supply voltages have only insignificant variations and thus coincide with one another. Thus, the output reference voltage $V_{BG}$ can be regarded to be substantially independent of the variation of power supply. Besides, it can be obtained from FIG. 4A that when the temperature increases from −20° C. to 100° C., the output reference voltage $V_{BG}$ varies from about 884.1 mV (corresponding to −20° C.) to about 886.4 mV (corresponding to 55.12° C.). It can also be obtained from FIG. 4B that when the temperature increases from −20° C. to 100° C., the output reference voltage $V_{BG}$ varies from about 721.5 mV (corresponding to −20° C.) to about 725.85 mV (corresponding to 28.34° C.). Therefore, the output reference voltage $V_{BG}$ can be regarded to be substantially independent of temperature variation.

Figure 5:
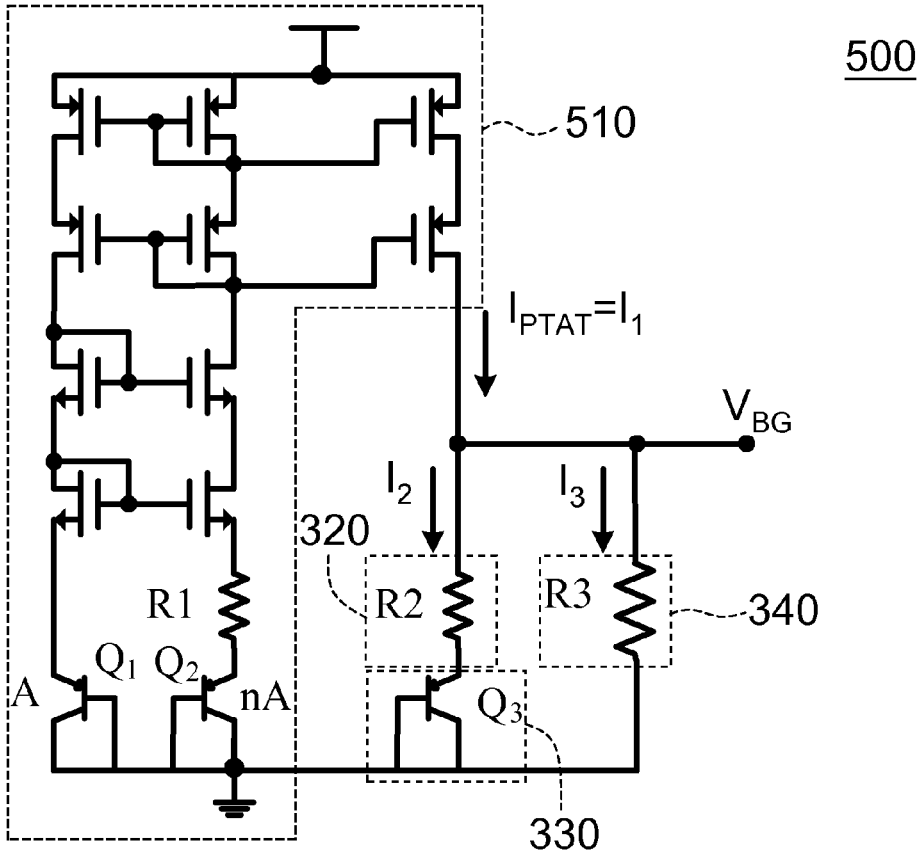
FIG. 5 is a circuit diagram of another example of the bandgap reference circuit according to the first embodiment of the invention.
Figure 6:
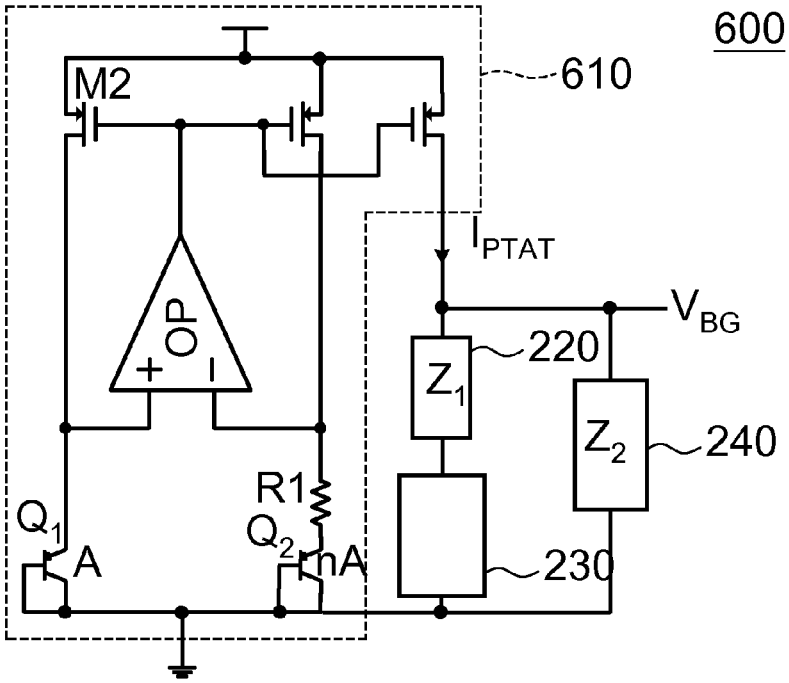
FIGS. 6 and 7 are other examples of the circuits with the characteristic of positive temperature coefficient, which can be employed in implementation according to the first embodiment of the invention.
Figure 7:
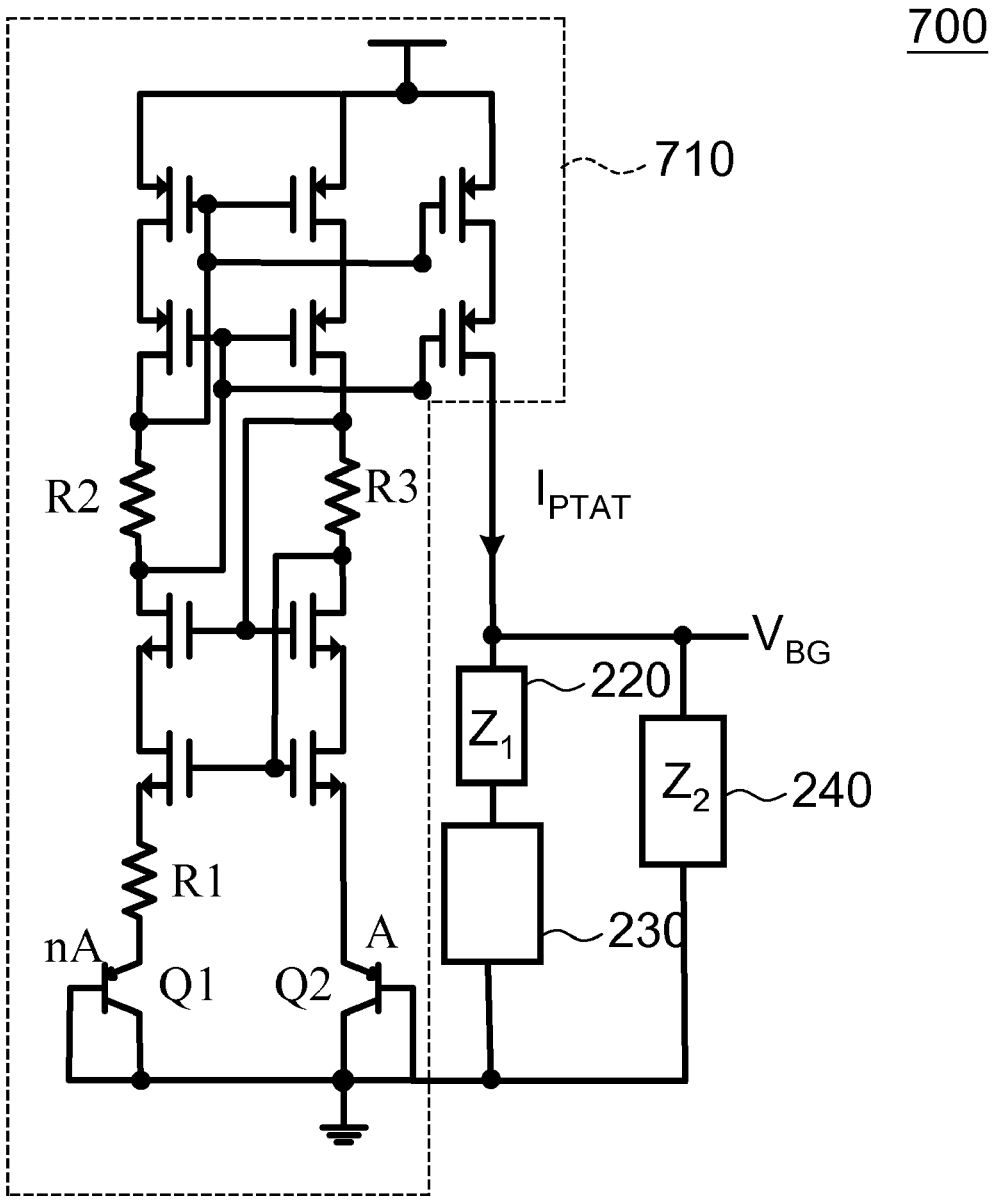

Further, FIG. 5 shows a circuit diagram of another example of the bandgap reference circuit according to the first embodiment of the invention. The difference between the bandgap reference circuit 500 and the bandgap reference circuit 300 of FIG. 3 lies in the different first reference signal generator 510. FIGS. 6 and 7 show other examples of the circuit having the characteristic of positive temperature coefficient, which can be employed in implementation according to the first embodiment of the invention. The bandgap reference circuit 600 of FIG. 6 includes a first reference signal generator 610, which is a circuit having the feature of positive temperature coefficient. The bandgap reference circuit 700 of FIG. 7 includes a first reference signal generator 710, which is a circuit having the characteristic of positive temperature coefficient. Therefore, any one skilled in the related art would realize any other circuits having the characteristic of positive temperature coefficient can also be employed to implement the first reference signal generator.

Embodiment Two

Figure 8:
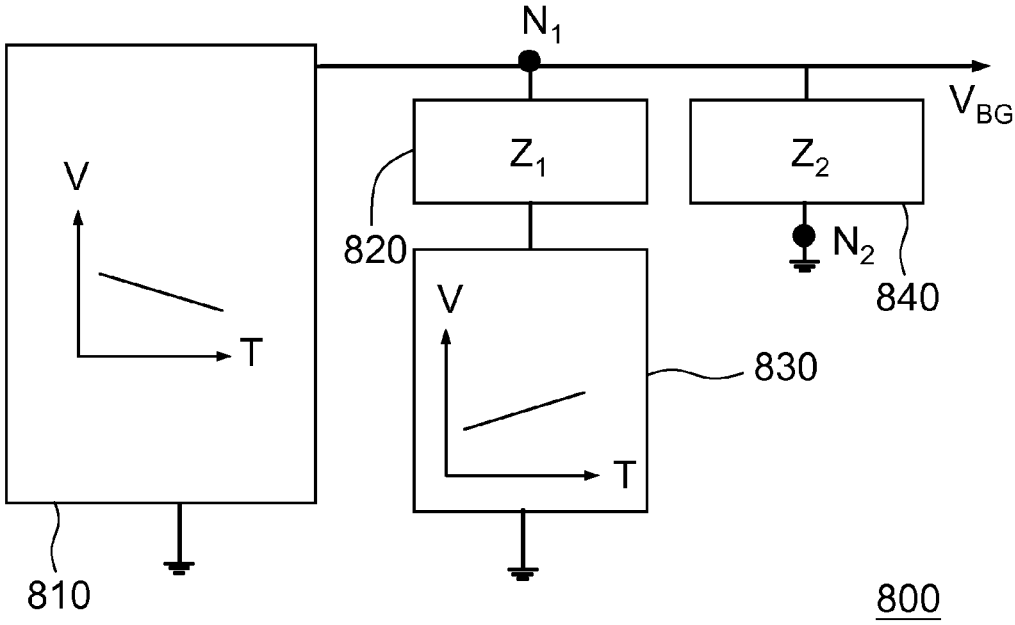
FIG. 8 is a block diagram of a bandgap reference circuit according to a second embodiment of the invention.

Referring to FIG. 8, a block diagram of a bandgap reference circuit according to a second embodiment of the invention is shown. The difference between the bandgap reference circuit of FIG. 8 and the bandgap reference circuit 200 of FIG. 2 lies in that the first reference signal generator 810 of the bandgap reference circuit 800 is a circuit having the characteristic of negative temperature coefficient, and the second reference circuit generator 830 is a circuit having the characteristic of positive temperature coefficient.

Figure 9:
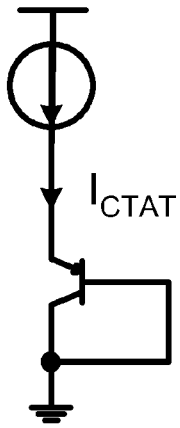
FIGS. 9, 10 and 11 show examples of the circuits having the characteristic of negative temperature coefficient, which can be employed in implementation according to the second embodiment of the invention.
Figure 10:
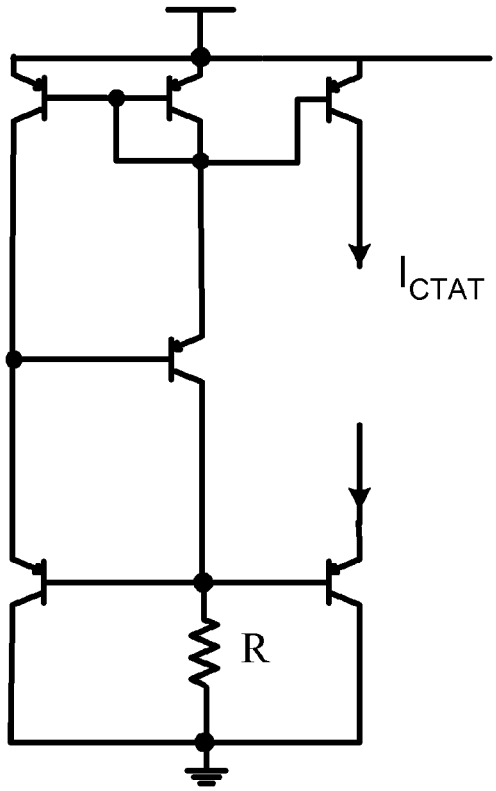
Figure 11:
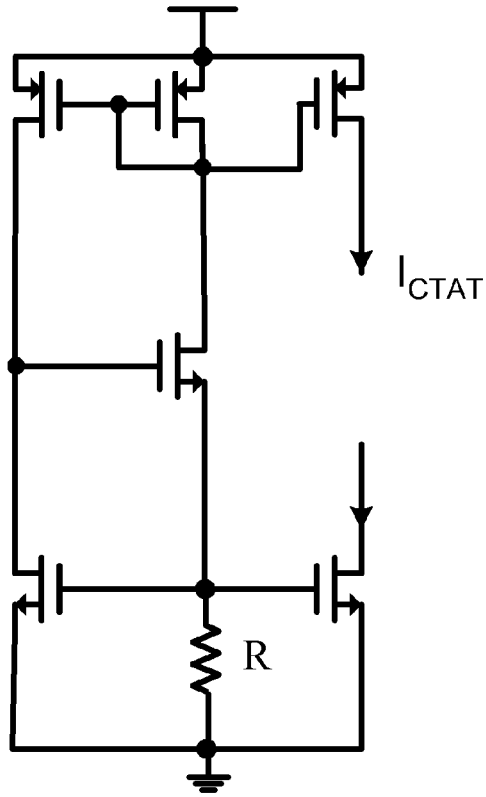

The first reference signal generator 810 generates a first reference signal complementary to absolute temperature, such as a current $I_{CTAT}$ having a negative temperature coefficient. FIGS. 9, 10 and 11 show examples of the circuits having the characteristic of negative temperature coefficient, which can be employed in implementing bandgap reference circuits according to the second embodiment of the invention.

The second reference signal generator 830 is for generating a second reference signal proportional to absolute temperature according to the first reference signal, such as a current $I_{PTAT}$ or a voltage having a positive temperature coefficient. The first reference signal compensates for the second reference signal such that the reference voltage $V_{BG}$ is substantially independent of the temperature and power supply. Therefore, the output reference voltage $V_{BG}$ is substantially determined by the first impedance 820, the second impedance 840, and a bandgap voltage value $V_g$. As such, one skilled in the related art can apply the circuit having the characteristic of positive temperature coefficient, such as one shown in FIG. 3, 5, 6 or 7, to implement, directly or by some modification, the second reference signal generator 830 of the second embodiment of the invention.

Conversely, as for the first embodiment, any one skilled in the related art can apply the circuit having the characteristic of negative temperature coefficient, such as one shown in FIG. 9, 10 or 11, to implement, directly or by some modification, the second reference signal generator 230 of the first embodiment of the invention.

Furthermore, in another example of the bandgap reference circuits of the first and second embodiments, the second impedance can be an equivalent impedance of a loop having a number of impedances coupled to each other in series or in parallel. In another example, the second impedance can be an adjustable impedance, or the second impedance can be an adjustable impedance controlled and adjusted by a control signal. Therefore, in other embodiments, the output reference voltage $V_{BG}$ can be dynamically adjusted as needed, or the value of the output reference voltage $V_{BG}$ can be selected in a digital manner.

The bandgap reference circuits according to the above embodiments of the invention can effectively generate an output reference voltage substantially independent of the temperature and power supply, and, when required, adjust the value of the output reference voltage by altering the impedances or design changes, and especially, obtain a bandgap reference voltage smaller than 1.25V. Besides, the low voltage bandgap reference circuit according to the invention can be implemented by using an additional circuit of lower complexity, such as implemented simply by resistors in the embodiment, thereby reducing the circuit area and complexity of the whole integrated circuit. As shown in the above embodiments, a configuration of reduced complexity for replacing the conventional complicated additional circuit effectively generates a smaller reference voltage and brings flexibility in application design, thus also reducing the manufacturing cost effectively.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A bandgap reference circuit for generating an output reference voltage, comprising:

a first reference signal generator, having an output terminal coupled to a first node, for generating a first reference signal proportional to absolute temperature (PTAT) from the output terminal;

a first impedance;

a second reference signal generator, coupled to the first impedance in series, for generating a second reference signal complementary to absolute temperature (CTAT) according to the first reference signal; and a second impedance, wherein the second impedance, the serially-coupled first impedance and second reference signal generator, and the first reference signal generator are coupled in parallel between the first node and a second node; the bandgap reference circuit outputs the output reference voltage through the first node and the second node;

wherein the first reference signal compensates for the second reference signal such that the output reference voltage is substantially independent of temperature and power supply, and the output reference signal is substantially determined by the first impedance, the second impedance and a bandgap voltage value.

2. The bandgap reference circuit according to claim 1, wherein the second impedance is for making the output reference voltage smaller than the bandgap voltage value.

3. The bandgap reference circuit according to claim 2, wherein the second impedance is an equivalent impedance of a loop having a plurality of impedances.

4. The bandgap reference circuit according to claim 2, wherein the bandgap voltage value is approximately equal to 1.25 V.

5. The bandgap reference circuit according to claim 2, wherein the second impedance is an adjustable impedance.

6. The bandgap reference circuit according to claim 5, wherein the adjustable impedance is controlled and adjusted by a control signal.

7. The bandgap reference circuit according to claim 1, wherein the output reference voltage is substantially determined according to $$\frac{Z_2}{Z_1 + Z_2} \times Vg,$$

and $Z_1$, $Z_2$, $V_g$ are values of the first impedance, the second impedance and the bandgap voltage value, respectively.

8. The bandgap reference circuit according to claim 7, wherein the bandgap voltage value is approximately equal to 1.25 V.

9. The bandgap reference circuit according to claim 1, wherein the first impedance has a voltage drop proportional to the absolute temperature, the second reference signal is a voltage complementary to the absolute temperature, the voltage proportional to the absolute temperature compensates for the voltage complementary to the absolute temperature such that the output reference voltage is substantially independent of the temperature and power supply.

10. The bandgap reference circuit according to claim 1, wherein the first impedance and the second impedance are resistors.

11. A bandgap reference circuit for generating an output reference voltage, comprising:

a first reference signal generator, having an output terminal coupled to a first node, for generating a first reference signal complementary to absolute temperature (CTAT) from the output terminal;

a first impedance;

a second reference signal generator, coupled to the first impedance in series, for generating a second reference signal proportional to absolute temperature (PTAT) according to the first reference signal; and a second impedance, wherein the second impedance, the serially-coupled first impedance and second reference signal generator, and the first reference signal generator are coupled in parallel between the first node and a second node; the bandgap reference circuit outputs the output reference voltage through the first node and the second node;

wherein the first reference signal compensates with the second reference signal such that the output reference voltage is substantially independent of temperature and power supply, and the output reference signal is substantially determined by the first impedance, the second impedance and a bandgap voltage value.

12. The bandgap reference circuit according to claim 11, wherein the second impedance is for making the output reference voltage smaller than the bandgap voltage value.

13. The bandgap reference circuit according to claim 12, wherein the second impedance is an equivalent impedance of a loop having a plurality of impedances.

14. The bandgap reference circuit according to claim 12, wherein the bandgap voltage value is approximately equal to 1.25 V.

15. The bandgap reference circuit according to claim 12, wherein the second impedance is an adjustable impedance.

16. The bandgap reference circuit according to claim 15, wherein the adjustable impedance is controlled and adjusted by a control signal.

17. The bandgap reference circuit according to claim 11, wherein the output reference voltage is substantially determined according to $$\frac{Z_2}{Z_1 + Z_2} \times Vg,$$

and $Z_1$, $Z_2$, $V_g$ are values of the first impedance, the second impedance and the bandgap voltage value, respectively.

18. The bandgap reference circuit according to claim 17, wherein the bandgap voltage value is approximately equal to 1.25 V.

19. The bandgap reference circuit according to claim 11, wherein the first impedance has a voltage drop complementary to the absolute temperature, the second reference signal is a voltage proportional to the absolute temperature, the voltage proportional to the absolute temperature compensates with the voltage complementary to the absolute temperature such that the output reference voltage is substantially independent of the temperature and the power supply.

20. The bandgap reference circuit according to claim 11, wherein the first impedance and the second impedance are resistors.

* * * * *